US008948689B2

(12) United States Patent
Simoens

(10) Patent No.: US 8,948,689 B2
(45) Date of Patent: Feb. 3, 2015

(54) REMOTE CONTROLLED AIR GUN

(75) Inventor: Hervé Simoens, Marcq-en-Baroeul (FR)

(73) Assignee: Societe Financiere de Gestion, Roubaix (FR)

( * ) Notice: Subject to any disclaimer, the term of this patent is extended or adjusted under 35 U.S.C. 154(b) by 236 days.

(21) Appl. No.: 13/502,013

(22) PCT Filed: Oct. 1, 2010

(86) PCT No.: PCT/FR2010/000653

§ 371 (c)(1),
(2), (4) Date: Apr. 13, 2012

(87) PCT Pub. No.: WO2011/045481

PCT Pub. Date: Apr. 21, 2011

(65) Prior Publication Data

US 2012/0208453 A1 Aug. 16, 2012

(30) Foreign Application Priority Data

Oct. 14, 2009 (FR) ..... 09 04929
Oct. 14, 2009 (FR) ..... 09 04930

(51) Int. Cl.
*H04B 7/14* (2006.01)
*B65D 88/70* (2006.01)

(52) U.S. Cl.
CPC ..... *B65D 88/703* (2013.01)
USPC ..... 455/15; 455/550.1; 455/556.1; 455/556.2

(58) Field of Classification Search
USPC ..... 455/550.1, 556.1, 556.2, 15; 89/1.7
See application file for complete search history.

(56) References Cited

U.S. PATENT DOCUMENTS

| | | | | |
|---|---|---|---|---|
| 6,685,159 | B1 | 2/2004 | Schnell | |
| 7,926,408 | B1 * | 4/2011 | Kley | 89/41.17 |
| 2005/0285069 | A1 | 12/2005 | Fernandez-Sein | |
| 2012/0092490 | A1 * | 4/2012 | Kley | 348/142 |

FOREIGN PATENT DOCUMENTS

| | | | |
|---|---|---|---|
| EP | 1 647 751 | A1 | 4/2006 |
| EP | 1 719 722 | A1 | 11/2006 |
| WO | WO 2006/096092 | A1 | 9/2006 |
| WO | WO 2008/078323 | A1 | 7/2008 |

* cited by examiner

*Primary Examiner* — Fayyaz Alam
(74) *Attorney, Agent, or Firm* — Miles & Stockbridge P.C.

(57) ABSTRACT

An air gun system producing blasts resulting from the rapid opening of a main valve by movement of a piston which, as it moves out of its seat, releases air accumulated under pressure in a tank, the opening of the valve being triggered by an electric control module located on or in immediate proximity to the air gun controlled by an automatic command generator, in which the control module communicates with the command generator using two-way wireless communication.

11 Claims, 2 Drawing Sheets

REMOTE CONTROLLED AIR GUN

FIELD OF THE INVENTION

Figure 1:
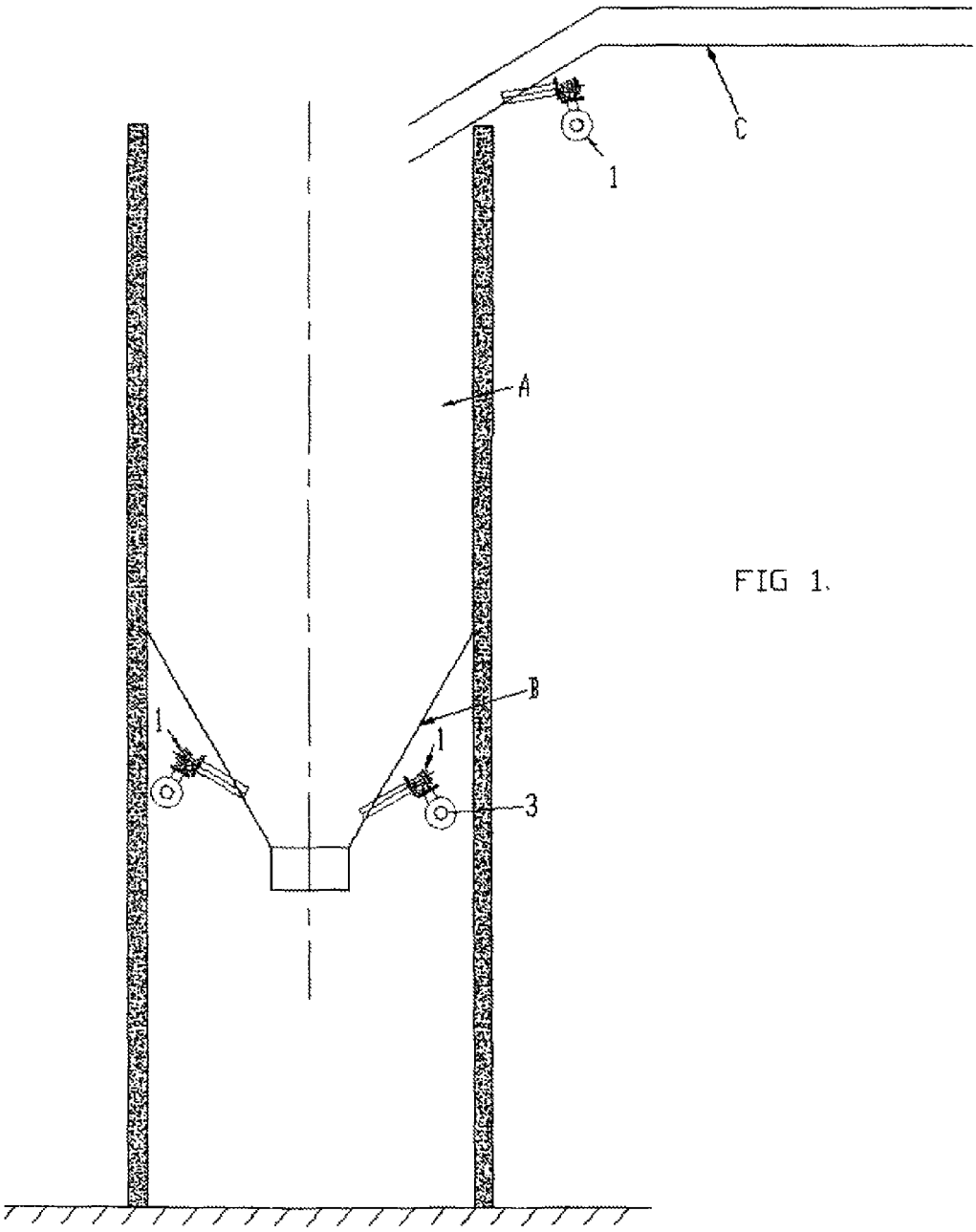

The invention relates to an air gun.

BACKGROUND OF THE INVENTION

To eliminate clogging in various facilities (cement kilns, bulk storage silos, grain silos, etc.), instead of using tools requiring manual operation by a worker such as scaling bars, it is known to use air guns, each of which produces a blast of air that will destroy or disperse the mass of material that has accumulated since the previous blasting.

These air guns work in the following way:

Air is accumulated in a tank fed by a compressed air supply circuit; a main valve controlled by a secondary valve controls the very rapid release of the air accumulated in the tank.

The very rapid discharge of the pressurized air contained in the tank produces a blast.

In the known air guns, the placement of the main valve is such that, locally, the front face of the valve piston is subjected to the pressure prevailing inside the tank, while the rear face of said piston is subjected to an equal counter-pressure prevailing in a rear chamber, itself fed by the tank.

Given the differences between the front and rear surfaces of the main valve subjected to equal pressure, the main valve is held in its seat by a slight force differential.

In order to open the main valve, a secondary solenoid-type valve triggers the evacuation of the rear chamber via a discharge conduit.

The evacuation of the air contained in the rear chamber creates an imbalance in the forces exerted on the piston of the main valve, allowing the opening that enables the air to be abruptly discharged from the tank because of the rapid movement of the piston.

To open the rear chamber, it suffices to supply electric power to the electromagnet of a solenoid valve so that the main valve opens. Since the volume of the chamber is small, this discharge is rapid.

The control module of the secondary solenoid-type valve is often mounted directly on the air gun, and this control module is supplied with power by an electric power cable. The control module uses a timer or counter that makes it possible to adjust the time between two blasts. The electric cable supplies power to the control module.

These devices are widely used in cement production facilities in which the environmental conditions are brutal. These materials are produced in kilns in an environment containing corrosive dust with a temperature of more than 50° C.

The advantage of these devices is that they can operate automatically; in some cases, they are positioned in places that are difficult to access and/or in areas where the temperature and/or dust conditions are dangerous.

They make it possible to avoid endangering operators working manually with scaling bars.

Several air guns are often necessary to handle a single area.

Generally, they work in complementary fashion, meaning that several air guns installed in one area will not all be actuated at the same time, but in a cycle that must be adjusted in accordance with various parameters.

The operating cycle is determined in advance, but sometimes changes are made during use. As mentioned, the firing rate is adjusted by programming a unit located on the rear of the air gun or in its immediate proximity, or in a remote control box housing a command generator. In theory, this programming is done during the installation of the air gun, since any subsequent intervention will be difficult, especially if it requires someone to work in proximity to the gun.

Electric power is supplied to the control module by an electric cable running through the structures of the plant, which in theory allows it to operate continuously. Unless there is an accidental cutoff of the power supply, the control module is always powered up. These cables are supported by cable trays, which in theory should not pose a problem, but because they are in a hostile environment, the presence of these cables increases the risk of failures, for example resulting from insufficient insulation or the accidental severing of a cable (the length of the cables often exceeds 100 meters). It is increasingly common for the actual control unit of the solenoid valve to be remote from the gun, so there is also a control cable running through the cable trays. In that case, the command generator transmits a command via a wired connection to the control module, which actuates either the secondary valve or an actuator.

Because of the difficulty of access, users only rarely intervene between maintenance operations and do not attempt to optimize the firing rates.

Thus, if the working conditions change, causing more accumulations to be generated, the system is left to run with no modifications until there is a shutdown of the facility or an urgent need.

Periodically, it is necessary to inspect the operation of the air gun, and thus the module is equipped with a manual control placed on the gun. This requires the technician to access the gun and fire it. Since these inspections take place in dangerous locations, there is a long interval between inspections.

It must not be forgotten that the blast produces a significant level of noise, especially if the operator is nearby.

The air tank is supplied by an air conduit and the electronic control unit is supplied with power by an electric cable. These supply lines must obviously be connected to the structures via different cable trays.

In short, the air gun, its tank, and its electronic control unit are positioned as near as possible to the area to be treated, and this assembly is supplied by both an air conduit and an electric cable. Assuming that the power supply is "endless," and that the electric cable is a physical connection, a properly equipped installation should not have any supply problems.

Unfortunately, it has been observed that malfunctions can occur due to severed cables or an error in the control unit that has gone unnoticed. Thus, personnel are regularly sent in proximity to the gun to fire a blast and/or to verify that the gun is firing at regular intervals.

It is clear that this is dangerous.

Installations using several guns are provided with a main control box that sends instructions to secondary control boxes which control a given number of guns. There is therefore cabling (wired connections) between the main box and the secondary boxes, and between the secondary boxes and the air guns.

Since all of the cables pass through the wall of the control box, each passage is provided with a mandatory cable gland due to the corrosive and dusty environment (risk of explosion).

The wired connection between the command generator and the control module theoretically makes it possible to carry a signal with long-term reliability; however, it increases the risk of faulty instructions due to a rupture in the cables carrying the signal. It must not be forgotten that this is a dangerous industrial environment with long distances. Likewise, because of losses, the distance between the gun and the command generator is limited to around 50 meters. Thus, in industries in which air guns are spread over a large surface area, the number of command generators must be increased and a monitoring technician must move from one generator to another to make sure that there have been no malfunctions.

In a conventional (wired) installation, once the command is sent to the gun via the wired communication line, the blast is considered to have taken place even if a failure occurs. In reality, the solenoid valve may remain open or closed, in which case the blast does not occur. Often the malfunction does not become evident until it is too late.

There is an installation known from WO 2006/096092, which describes a clog sensor connected to a control module—itself connected to an air gun—which will indicate the presence of an accumulation and trigger a blast. That document indicates the theoretical possibility of replacing the cables with a wireless network without providing any details on its design.

Wireless transmission is a known means, but because it poses problems in industrial environments in which there are many metal parts that interfere with the delivery of the signals, it is not used.

SUMMARY OF THE INVENTION

The object of the invention is to provide a solution for limiting the causes of failures, reducing installation costs and facilitating control of the operation of these air guns.

To this end, the subject of the invention is an installation comprising at least one air gun producing blasts resulting from the rapid opening of a main valve by the movement of a piston which, as it moves out of its seat, releases the so-called working air accumulated under pressure in a tank, the opening of said valve being triggered by an electric control module located on or in immediate proximity to the air gun controlled by a command generator generating automatic firing commands, this installation being characterized in that the control module comprises a receiver of commands transmitted remotely by a wireless transmitter and a transmitter for transmitting information back to the command generator, which itself comprises a receiver, and said command generator 8 comprises a means for manually triggering a blast.

BRIEF DESPCRIPTION OF THE DRAWINGS

The invention will be clearly understood with the help of the description below, given as a non-limiting example in connection with the diagram, which illustrates:

FIG. 1: A grain silo.

Figure 2:
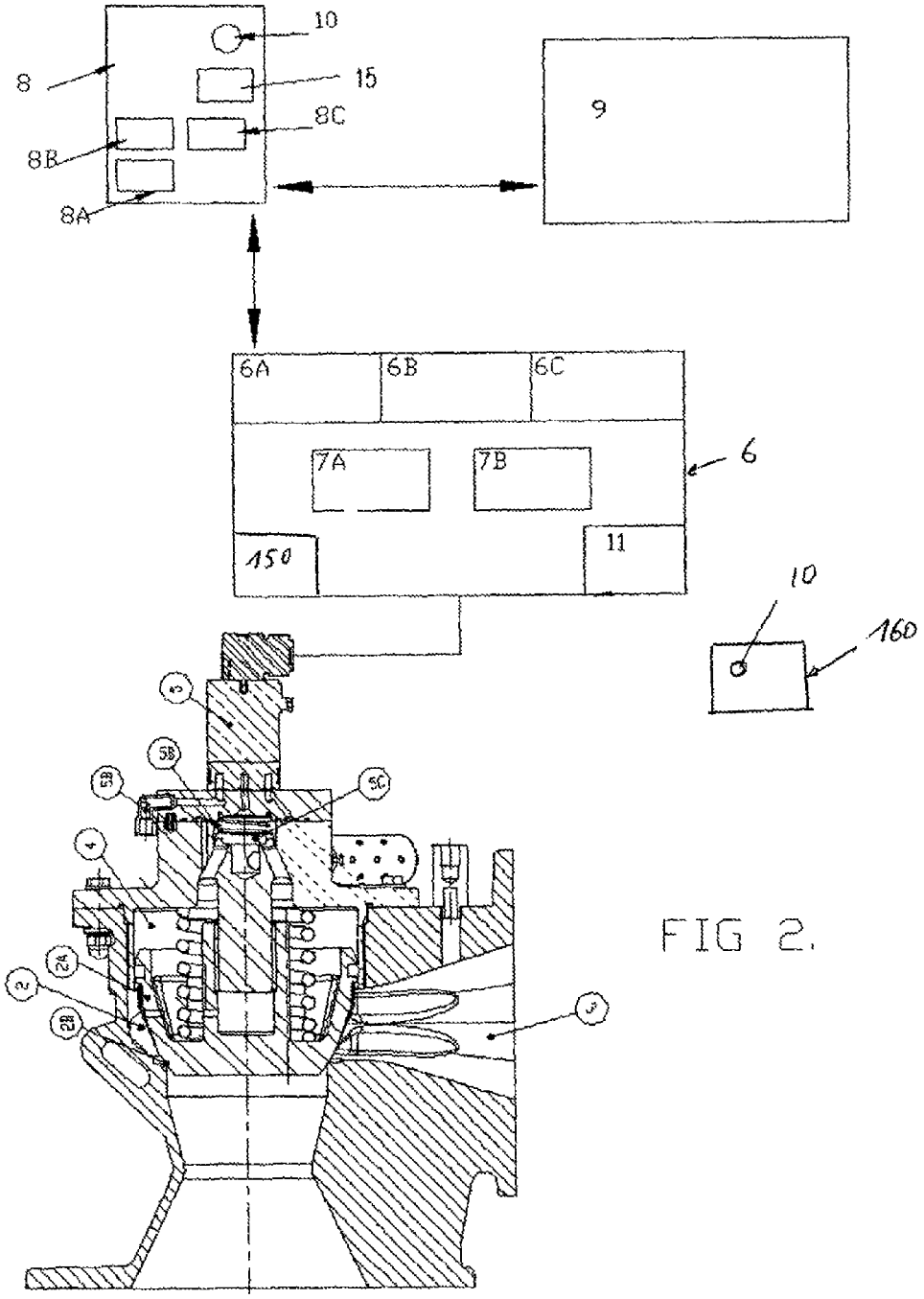

FIG. 2: An exemplary air gun.

DETAILED DESCRIPTION

Referring to the drawing, we see an exemplary air gun 1 for producing blasts for destroying and/or preventing accumulations of powdered or granulated materials resulting in clogs.

FIG. 1 illustrates a silo A with its discharge hopper B. A truck can be placed underneath this hopper for loading grain.

The hopper is equipped with two air guns 1 and the tube C for delivering grain into the silo.

This air gun comprises a main valve 2 that controls the flow of the so-called working air contained in a tank 3.

The piston 2A of this main valve rests against its seat 2B at least while the tank is filled. The piston can be flat, guided by a guide rod, or cup-shaped. Its shape is not crucial to the technical aspect of the invention. This main valve is subjected to two opposing forces. A first force tends to move the piston out of its seat. Part of the front face of this valve is subjected to the pressure prevailing inside the tank.

This piston is also held in said seat by the pressure exerted in a rear chamber.

The force that presses the piston 2A of the main valve into its seat depends on the pressure in a rear chamber 4 and on the rear surface exposed to said pressure.

The force that presses the piston 2A into its seat must be greater than that which tends to move it out of said seat. The differential between the forces is nevertheless slight.

The pressures on the front and rear of the piston are often identical, and it is the surface differential that determines the forces applied.

The evacuation of the air contained in the rear chamber is controlled by a solenoid valve 5 or actuator. Thus, when the air is evacuated from the rear chamber, the piston or cup of the main valve retracts and the air in the tank is rapidly discharged.

In the example illustrated, the solenoid valve 5 makes it possible to evacuate 5B the chamber 5A, thus driving the movement of the piston. It is also possible to evacuate it via another path.

An electronic control module 6 actuates the solenoid valve. The commands are generated by a remote command generator 8.

Additionally, a memory 6A, a counter 6B and a clock 6C are installed for periodically triggering the operation of the solenoid valve. The electronic unit of the control module is adapted to the actuator.

In general, the opening of the valve results from an action induced by an electric control module 6 located on or in immediate proximity to the air gun that acts on a sort of lock. This control module, for example, opens the solenoid valve 5, which is the lock, by sending an impulse to the coil of the solenoid valve.

The means for opening the main valve can also be a means other than a solenoid valve.

According to one feature, the electric control module 6 comprises a wireless communication system composed of a receiver 7A and a transmitter 7B for communicating with a remote command generator 8, which command generator has transmitting and receiving means for two-way wireless communication with the control module 6, and a manual triggering means.

Thus, there is a receiver 7A of commands transmitted by a wireless transmitter 8A that is remote from the receiver 7A with which said control module is equipped.

The command generator 8 is in the form of a control box and/or a remote control device 8.

The term command generator is understood to mean, in particular, a computer or automation system capable of automatically generating a command for triggering the gun.

The communication between the command generator 8 and the control module 6 is either radio or infrared communication.

The control box being stationary, it can be supplemented by one or more remote control devices 160 that an operator can use to contact the air gun in order to trigger the blast and view its effects without having to get too close. The operator can at least hear the blast, which confirms that the gun has fired.

This technical solution is very advantageous because it makes it possible to place the command generator far from the guns, i.e., in a control room that is not exposed to the dangerous atmosphere near the gun. Depending on the distance between the generator and the gun, means 200 for repeating the signal may be provided.

The communication means installed in the electronic control module 6 are an instruction receiver 7A and a transmitter 7B.

The transmitter 7B with which the control module 6 is equipped is used to transmit back to the command generator 8 information such as "firing command received and executed," the number of blasts fired, the pressure in the tank connected to the air gun, etc.

The control module 6 comprises a means 150 for verifying that the command has been received and/or that the solenoid valve is operating, and said means is capable of generating an OK signal sent to the command generator.

This feedback of information is very important, since previously the only thing monitored was the generator 8, which did not indicate whether the gun had received the firing command.

In a first embodiment, the electronic control module 6, which is housed in a control box, can include a memory in order to store a program for actuating the secondary valve by means of a microcontroller or a microprocessor. The receiver 7A of the control module makes it possible not only to receive a firing command but also to send the microprocessor data for modifying the stored program. Both the signal sent by the command generator and the one transmitted back to said generator include an identifier that makes it possible to recognize the air gun.

Using this command generator or by means of a remote control accessory, when the control module includes a program that generates firing commands from a received instruction, it is possible to reprogram the interval between two blasts, and possibly also the time lag between a gun and one or more other guns, by sending the receiver 7A the corresponding data.

The presence of a transmitter 7B in the control module makes it possible to send, in the direction of the command generator or the remote control, information on the air gun, for example the number of blasts produced, etc.

Preferably, for safety reasons, the electronic means installed on the air gun and hence in the control module 6 do not include an autonomous command generator for opening the valve. This means that the electronic control module 6 is a slave controlled by the command generator 8 housed in the control box or the remote control device.

In order for this control module installed on or in immediate proximity to the gun to trigger the opening of the valve, it must have received a firing command from the control box or the remote control device. Thus, handling this control module 6 does not run the risk of triggering an accidental blast.

The command generator 8 includes a means for manually triggering a blast and means for creating automatic firing commands.

In the case where the control module 6 is a slave, the operating system 8C for controlling the operation of the air gun is installed in the command generator 8 contained in the remote control device or the control box.

The command generator 8 therefore includes a transmitter 8A and a receiver 8B.

The remote control device will also include these two-way communication means in addition to the button for manually triggering the blast.

Optionally, the blasts are programmed, for example on a computer 9 or an equivalent means, then transferred to the command generator 8. This transfer from the computer can be done either through a wired connection via a USB port or a radio or infrared connection via an appropriate port. A memory 15 for the data and an operating system are associated with the command generator.

A button 10 installed on the remote control device or the control box makes it possible to trigger a blast manually.

It will therefore be possible to trigger a test blast from an easily accessible location without excessive risk.

It is understood that another advantage of this wireless transmission feature is to ensure the safety of the operator, who is no longer required to go right up to the air gun as often in order to verify that it is operating by actuating a button installed directly on the gun.

A specific management program, for example for managing the energy used by the solenoid valve or the actuator of the valve, can be installed in the control module. For example, it is possible to monitor the pressure in the tank.

It is easy to change this management program and/or the firing procedure without going right up to the air gun.

Advantageously, the power for the electronic unit 6 mounted on the gun can be supplied by means of a battery 11 so that the electric power cables and the cables carrying the instructions can be eliminated. This feature, combined with the wireless connection, is very safe and economical.

This eliminates many causes of failures (severing of cables, lack of insulation, etc.) as well as the additional cost of installing these cables or periodically replacing said cables.

It will of course be necessary to periodically change the battery; hence the advantage of providing in the control module a transmitter 7B that will transmit the state of charge of said battery.

This solution of using a battery to power the solenoid valve is paradoxical because it requires periodic human intervention to replace the battery with a new one whereas, in theory, the cable solution does not require such intervention, but since human intervention on the guns is already required, the operator will use that opportunity to change the battery. Preferably, the capacity of the battery (cell) should be adapted to the frequency of the intervention and the rate of power consumption.

Provisions have been made for limiting the power consumption of this electronic control unit.

The electronic control unit includes, for example, a standby mode to save energy.

Energy-saving components are used.

In this solution, the wiring that was needed to supply power to the solenoid valve and the control module is no longer necessary. Of course, the battery must be replaced regularly, but that can be done during regular maintenance, which requires inspecting various mechanical parts and thus accessing the air guns and the tank. It is important to keep in mind that some guns fire only once or twice a day.

The consumption is therefore low.

The battery can be a regular battery but it can also be an accumulator that can be charged by a solar panel or wind generator or driven by the compressed air used to load the tank. The distance between this generator and the battery will be small.

Using the remote control device, it is possible to retrieve information such as the number of blasts fired, the state of the battery, etc.

The communication will be established using a communication protocol such as, for example, Wi-Fi, Bluetooth, ZigBee or the like.

The electronic control device is protected from the ambient conditions (dust and heat). It is housed in a unit that may also house the radio antenna, which can also be remote.

In certain cases, repeaters will be used to route the signal originating from the transmitter 8A from the control box to the air gun when the configuration of the site interferes with the transmission or when the command generator is remote from the air guns. It is possible to construct a sort of mesh from a single command generator, this mesh being designed in accordance with the locations of the guns and the command generator, taking into account the distances and any obstacles interfering with the transmission of the signal.

Thus, to trigger the opening of the valve of a gun, the air gun is equipped with a valve-opening control module 6; this control module comprises a wireless transmitting/receiving means for communicating with an automatic command generator provided with a transmitting/receiving means. The command generator sends a firing command which, once received by the receiving means of the control module, will trigger the opening of the valve of the gun; when the command is received or when the valve is opened, a confirmation is sent to the generator. As it is sent, a state of the battery can also be sent, along with other information such as a failure of the air supply to the tank or insufficient pressure. The receipt of this feedback is very important since it makes it possible to trigger alarms.

This installation is easier to install since it avoids the need to lay cable, easier to control, and subject to fewer command transmission failures (in the event of a transmission failure, there is no acknowledgement of the receipt of said command, which triggers an alert).

The air gun may be said to be nearly self-contained, since the only connection is the air supply to the tank.

The invention claimed is:

1. A system comprising:

at least one air gun configured to produce blasts resulting from rapid opening of a main valve by movement of a piston which releases air accumulated under pressure in a tank as the piston moves out of its seat;

an electric control module disposed in proximity to said at least one air gun which is configured to trigger opening of said main valve; and a remote command generator which controls said electric control module and which is configured to generate automatic firing commands, wherein the electric control module comprises a wireless communication system which includes a wireless receiver and a wireless transmitter for communicating with the remote command generator, wherein the electric control module is configured to verify, using the wireless communication system, that a command sent by the remote command generator using the wireless communication system has been received, or that the main valve is operating, generator using the wireless communication system, and wherein said remote command generator comprises a command transmitter and a command receiver for two-way wireless communication with the control module; and a manual trigger device.

2. The system according to claim 1, wherein the command transmitter and a command receiver for two-way wireless communication are housed in a control box containing the remote command generator.

3. The system according to claim 2, further comprising:

at least one remote control device configured to manually trigger a blast and to receive information from the control module.

4. The system according to claim 1, wherein communication between the wireless transmitter and the wireless receiver is radio communication.

5. The system according to claim 1, wherein communication between the wireless transmitter and the wireless receiver is infrared communication.

6. The system according to claim 1, further comprising:

repeaters for routing signals originating from the command transmitter.

7. The system according to claim 1, wherein the control module is a slave module.

8. The system according to claim 1, wherein the control module and an actuator of the main valve are powered by a battery.

9. The system according to claim 8, wherein the actuator of the main valve is a solenoid valve.

10. The system according to claim 8, further comprising a generator for producing current for recharging the battery.

11. The system according to claim 10, wherein the generator is self-contained and is driven by compressed air supplied to the at least one air gun.

* * * * *